US005812038A

United States Patent [19]

Gu et al.

[11] Patent Number: 5,812,038

[45] Date of Patent: Sep. 22, 1998

[54] VOLUME EFFICIENT RESONATOR

[75] Inventors: Wang-Chang Albert Gu; Chowdary Ramesh Koripella, both of Albuquerque, N. Mex.

[73] Assignee: Motorola, Inc., Schaumburg, Ill.

[21] Appl. No.: 614,451

[22] Filed: Mar. 12, 1996

Related U.S. Application Data

[63] Continuation of Ser. No. 254,719, Jun. 6, 1994, abandoned.

[51] Int. Cl.[6] ..... H01P 7/00

[52] U.S. Cl. ..... 333/219; 333/185

[58] Field of Search ..... 333/202, 219, 333/204, 205, 185, 175; 336/200

[56] References Cited

U.S. PATENT DOCUMENTS

| | | | |
|---|---|---|---|
| 4,418,324 | 11/1983 | Higgins | 333/219 |
| 4,494,100 | 1/1985 | Stengel et al. . | |
| 4,578,654 | 3/1986 | Tait | 333/219 |
| 4,700,158 | 10/1987 | Dorsey | 333/219 |
| 4,701,727 | 10/1987 | Wong | 333/219 |
| 4,981,838 | 1/1991 | Whitehead | 333/219 |
| 5,075,650 | 12/1991 | Okamura et al. | 333/185 |
| 5,105,176 | 4/1992 | Okamura et al. | 333/185 |
| 5,210,510 | 5/1993 | Karsikas | 333/219 |
| 5,404,118 | 4/1995 | Okamura et al. | 333/185 |

FOREIGN PATENT DOCUMENTS

| | | |
|---|---|---|
| 4-157903 | 5/1992 | Japan . |
| 4-257111 | 9/1992 | Japan . |
| 4-257112 | 9/1992 | Japan . |
| 5-335866 | 12/1993 | Japan . |
| 6-053716 | 2/1994 | Japan . |

*Primary Examiner*—Seungsook Ham
*Attorney, Agent, or Firm*—M. Mansour Ghomeshi

[57] ABSTRACT

A volume efficient resonator (100) includes a helical coil transmission line (108) fabricated on a plurality of dielectrics (212, 214, 216, 218, 220, 222, 224, and 226). The transmission line (108) includes selectively metalized areas (210) on the dielectric layers. The metalized areas are formed in half loops and interconnected at alternate terminals via through-holes (203 and 205). A distributed capacitor (106) is added to the transmission line (108) using another set of selectively metalized areas (208). The distributed capacitor (106) is shunted to a ground plane (202) via through-holes (204, 206).

15 Claims, 4 Drawing Sheets

VOLUME EFFICIENT RESONATOR

This is a continuation of application Ser. No. 08/254,719, filed Jun. 6, 1994, and now abandoned.

TECHNICAL FIELD

This invention is generally related to electronic components and more particularly to components utilizing transmission lines

BACKGROUND

Electrical transmission lines are used to transmit electric energy and signals from one point to another. The basic transmission line connects a source to a load—e.g. a transmitter to an antenna, an antenna to a receiver, or any other application that requires a signal to be passed from one point to another in a controlled manner. Electrical transmission lines, which can be described by their characteristic impedance and their electrical length, are an important electric component in radio frequency (RF) circuits. In particular, transmission lines can be used for impedance matching—i.e., matching the output impedance of one circuit to the input impedance of another circuit. Further, the electrical length of the transmission line, typically expressed as a function of signal wavelength, determines another important characteristic of the transmission line device.

Manipulation of the characteristic impedance and electrical length of the transmission line device is a well known technique to effect a particular electrical result. In particular, an output impedance, $Z_{out}$, can be matched to an input impedance, $Z_{in}$, according to a well known equation, as later described. Similarly, the attenuation and phase shift of the transmission line device can be altered by changing the physical length of the conductor between the input and output ports of the transmission line device. As an example, a resonant circuit results when the physical length of the conductor approximates an even one quarter wavelength of the signals nominal frequency.

Of course, at high frequencies the wavelength is small and transmission line devices can be built using relatively short conductors in small packages. By contrast, as the nominal frequency of the applied signal decreases, the physical length must necessarily increase to effect the desired transmission line characteristic. The physical length must correspondingly increase to accommodate such applications operating at lower frequencies.

Prior art techniques, including microstrip and stripline conductors, have been used successfully in the past to construct transmission line devices. Unfortunately, at lower frequencies—e.g., below 1 GHz—the substrates upon which these one-dimensional conductive strips are placed require a relatively large area, due to the excessive length requirements. As today's electronic devices shrink in size, the board space allotted for the necessary electrical components is correspondingly reduced. Thus, a substrate carrying a microstrip or a stripline conductor that serves as a transmission line device for low frequency signals simply cannot be accommodated by the available board space.

It is therefore desired to have a volumetrically efficient transmission line that could be used in todays small size electronic devices.

It is known that the length of a quarter-wave resonator can be significantly reduced by a shunt capacitor. The unloaded Q of the conventional resonator is solely determined by the attenuation factor of the line, while the shunt capacitor Q, in addition to the attenuation factor of the line, affects the unloaded Q of the quarter-wave resonator equivalent. For a capacitor with good component Q, it is expected the unloaded Q of the resonator equivalent may surpass its conventional counterpart.

DETAILED DESCRIPTION OF THE PREFERRED EMBODIMENT

To improve the Q of a resonator a capacitor is fabricated along the length of a resonator in accordance with the principles of the present invention. These principles may be applied to any electrical device whose performance may be improved via distributed capacitors. The distributed capacitor is fabricated by having plates overlapping portions of a coil that forms the transmission line for the electrical device. The distributed capacitor improves the overall Q of the resonator while maintaining the volume to a minimum. The principles of the present invention will be better understood by referring to a number of figures where similar reference numbers are carried forward.

Figure 1:
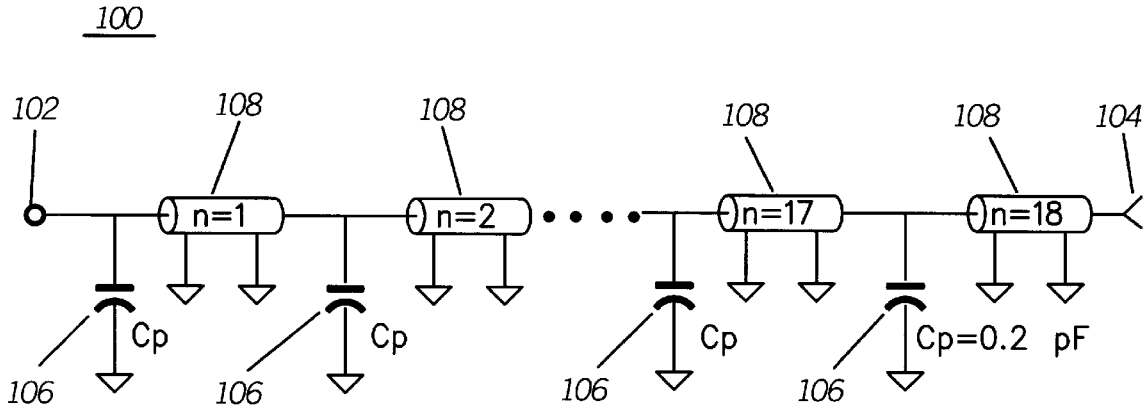
FIG. 1 is a electrical equivalent circuit of a transmission line in accordance with the present invention.

FIG. 1 shows an electrical equivalent circuit representation of a helical resonator 100 in accordance with the present invention. The resonator 100 includes a transmission line 108 and a distributed capacitor 106 along its length. The transmission line 108 is preferably a helical coil transmission line and is shown to comprise a plurality of segments representing its length L. Capacitors 106 are shown shunted to ground between the segments of the transmission line 108. These capacitors represent a distributed capacitance along the length L. A benefit of the distributed capacitor 106 it that it provides for a reduction in the length of the transmission line 108. In addition, an improvement in the resonator Q is achieved over a conventional transmission-line resonator without the distributed capacitance. The resonator 100 can be fabricated via the Multilayer printed circuit board (PCB) processes, or the Multilayer ceramic (MLC) processes. In both cases, conductor layers are either plated, as in the PCB processes, or printed, as in the MLC process, on dielectric layers. The processed dielectric layers are then aligned, and laminated to form the final assembly of resonator 100. The resonator 100 includes an input terminal 102 which is used to couple an input signal thereto. An output terminal 104 couples the resonator 100 to an output device. Although the input 102 and the output 104 are shown coupled to the transmission line 108 other points on the resonator 100 may be used for these purposes. The process of incorporating a distributed capacitance along the length of a resonator is of significant importance to the present invention and will be discussed below.

Figure 2:
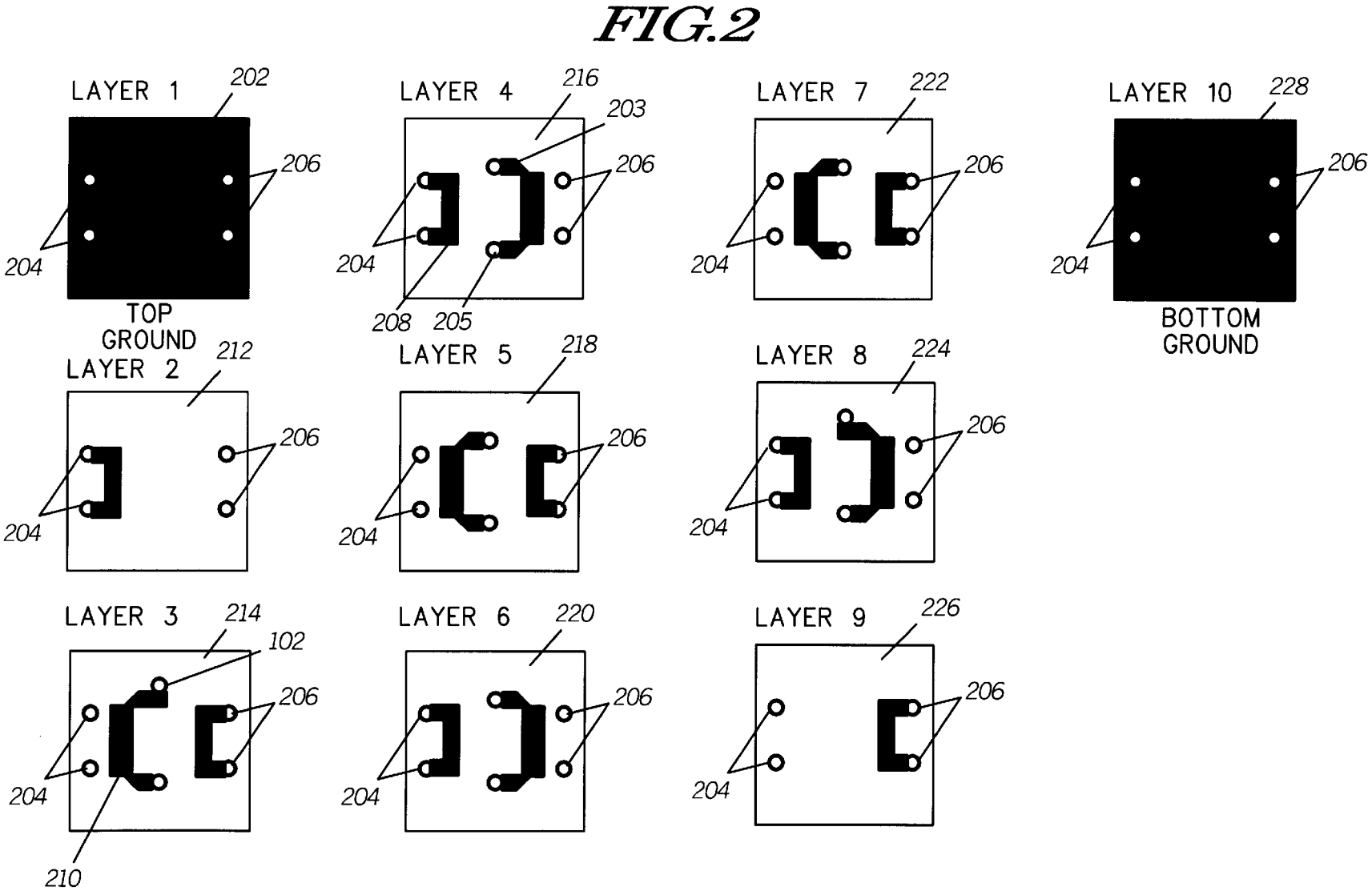
FIG. 2 shows the various elements of a transmission line in accordance with the present invention.

Referring to FIG. 2, the various layers involved in the manufacturing of the resonator 100 in accordance with the present invention are shown. The process includes punching or drilling "through-holes" or "via-holes" 203, 204, 205, and 206 on a plurality of dielectric tapes 202, 212, 214, 216, 218, 220, 222, 224, 226, and 228. These dielectric tapes are substrates of electrically isolating material such as ceramic. The through-holes 203, 204, 205, and 206 are then filled with conductor paste to form interconnects that provide the means for coupling metallized areas on the dielectric layers. Conductor patterns 208, and 210 are printed on a major surface, namely the top surface, of the dielectric tapes to form the distributed capacitor 106 and the transmission line 108, respectively. The conductor 210 are selectively metallized patterns in the form of half loops having first and second terminals. The alternate terminals of consecutive half loops are coupled to each other via the through-holes 203, 204, 205, and 206 to substantially form the helical transmission line 108. In addition, these half loops function as the first plate of the capacitor 106. The conductor patterns 208 form the second selectively metallized patterns a portion of which provides the second plate for the capacitor 106. It is noted that in order to maximize the volumetric efficiency the half loops may take any geometrical shape as dictated by the requirements of the resonator 100. In the preferred embodiment, these half loops are squares. However, circular shapes will provide similar performance. In addition to the geometry of the half loops, the metallized areas 208 and 210 are optimized by rendering their overlapping areas substantially similar. So if the half loop 210 is a half square, the pattern 208 is also formed as a square area so that maximum capacitance to volume ratio is achieved. The processed dielectric tapes are then stacked, aligned, and laminated. Finally, in the MLC processes, the laminated MLC substrate is sintered. Several factors affect the capacitance value of the capacitor 106. These factors include the thickness of the dielectric layers, the material of the dielectric and the overlapped metallization areas 208 and 210. Indeed, the capacitance may be trimmed to desired levels by exposing one of the capacitor plate and using a laser or a high-precision metal removing tool to trim the exposed layer and hence the capacitance. In order to obtain an adequate tuning range, the exposed capacitor plate and the one directly underneath it may be made larger than the interior capacitor plates.

Figure 3:
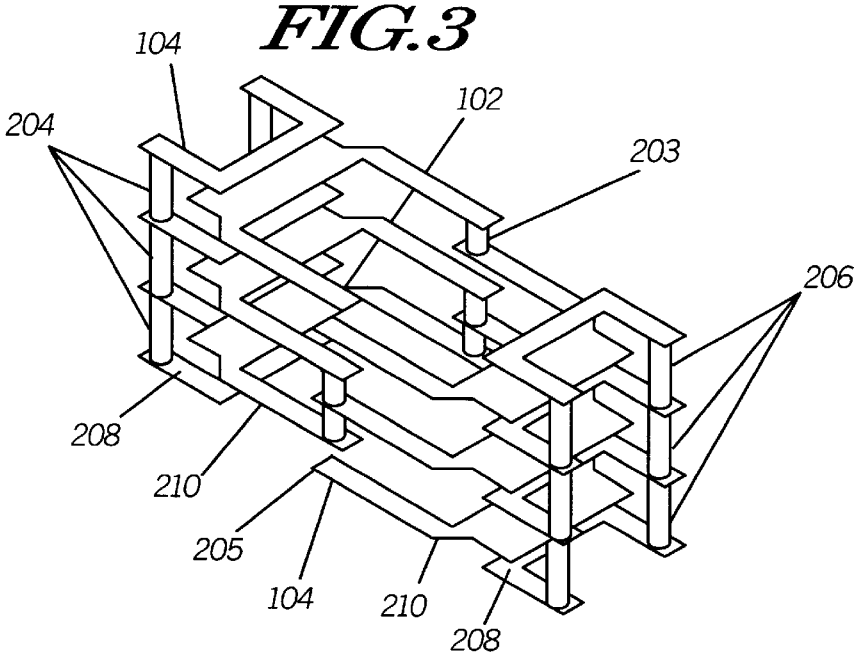
FIG. 3 shows an isometric view of a transmission line in accordance with the present invention.

Referring to FIG. 3 now, an isometric view of the resonator 100 is shown. Missing in this figure are the several dielectric layers. These layers are intentionally removed to enhance one's understanding of the way the several layers are interposed. In general, the helical transmission line 108 is formed with half-turn annuli 210 and vias 203 and 205. The half-turn annuli 210 are coupled to each other via alternate through-holes on each layer. They are extended on one side of the helical coils in such a way that these extensions form a plate of the distributed capacitor 106. The other plate is formed by the overlapping portion of the metalization areas 208. In the preferred embodiment, one end of the first annulus 210 forms the input 102 and one end of the last annulus 210 forms the output 104. It is understood that input and output signals can also be coupled to metalization 208 of the distributed capacitance on both sides of the helical resonator 100, thus, a four-port device can be formed. As can be seen, the metalization areas 208 are coupled to each other at one end via interconnects 204. This interconnection provides one terminal of the capacitance. In the preferred embodiment, this terminal is grounded by coupling the interconnects 204 and 206 to the top and bottom ground planes 202 and 228, respectively. The second terminal of the distributed capacitor 206 is formed via the metalization areas that overlap a portion of the metalization areas 210. In other words, a portion of the metalization 208 forms one plate of the capacitor 106 and a portion of the metalization 210 directly adjacent to the first plate forms the second plate.

Figure 4:
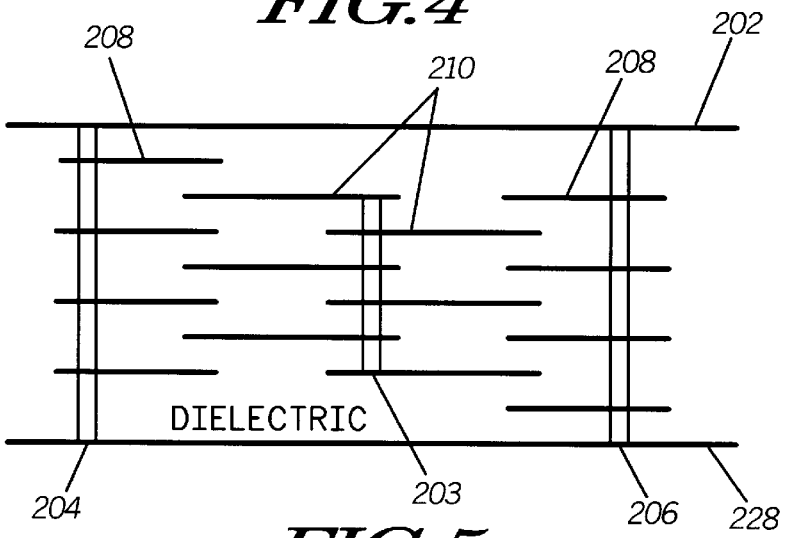
FIG. 4 shows a side view of a transmission line in accordance with the present invention.
Figure 5:
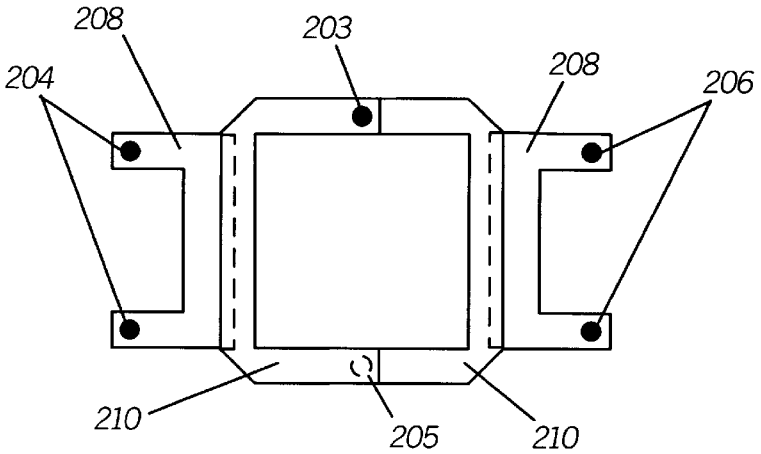
FIG. 5 shows a top view of a transmission line in accordance with the present invention.

Referring to FIGS. 4 and 5, side and top views of the resonator 100 in accordance with the present invention are shown. These two figures provide for a more clear understanding of how the distributed capacitor 106 is formed along the length of the transmission line 108. As can be seen from FIG. 4, the capacitor 106 formed via overlapping layers 210 and 208 extends over the length of the transmission line 108.

Figure 6:
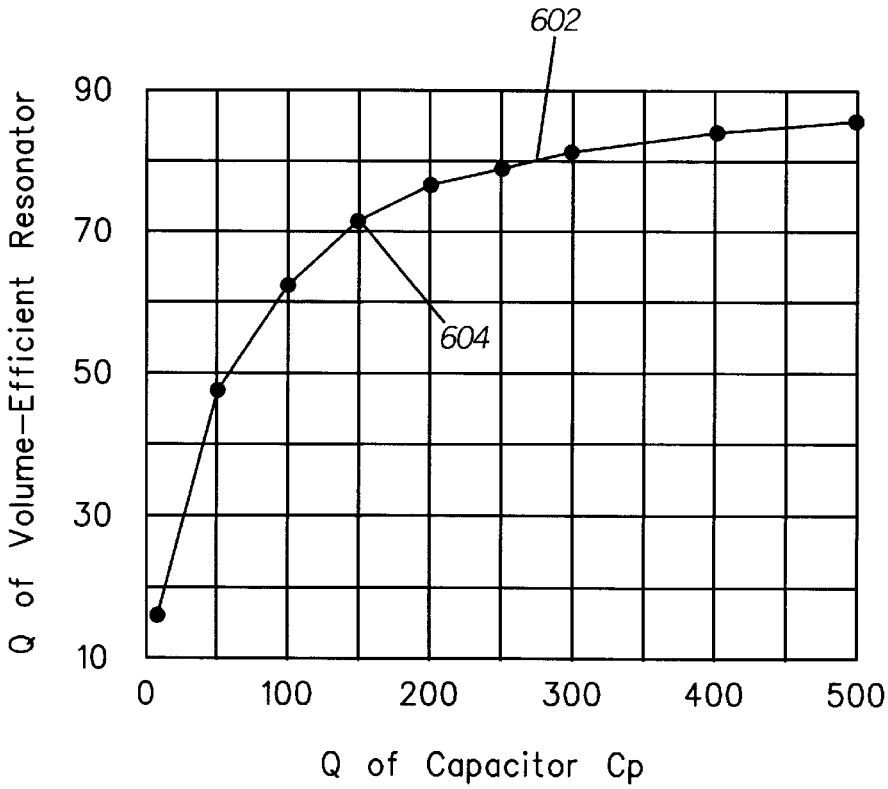
FIG. 6 shows a chart representing the performance of a resonator in accordance with the present invention.

Referring to FIG. 6, a graph representing the performance of the resonator 100 is shown. Graph 602 shows the Q of the resonator 100. Point 604 on this graph shows the Q of a conventional transmission line resonator without any capacitors. As can be seen significant improvements in the Q of the resonator 100 may be realized with the present invention. For a distributed capacitor Q of 150 or higher, the overall resonator Q exceeds that of the conventional transmission-line resonator, which has a Q of about 70 (point 604). In general, the Q of a conventional transmission-line resonator is determined by the metal loss, dielectric loss, and, in the case of unshielded structures, radiation loss. In many cases, it is the metal loss that limits the Q of the resonator. With the distributed capacitor 106, in addition to the conventional transmission-line losses, the Q of the distributed capacitor 106 also affects the overall Q of the resonator 100. However, with the distributed capacitor 106, the length of the transmission line 108 is significantly reduced, and the overall Q of the resonator may exceed the conventional transmission-line resonator. It should be noted that the numerical values as shown in FIG. 6. may vary if different circuit parameters are used, but the general observation should be easily verified.

Figure 7:
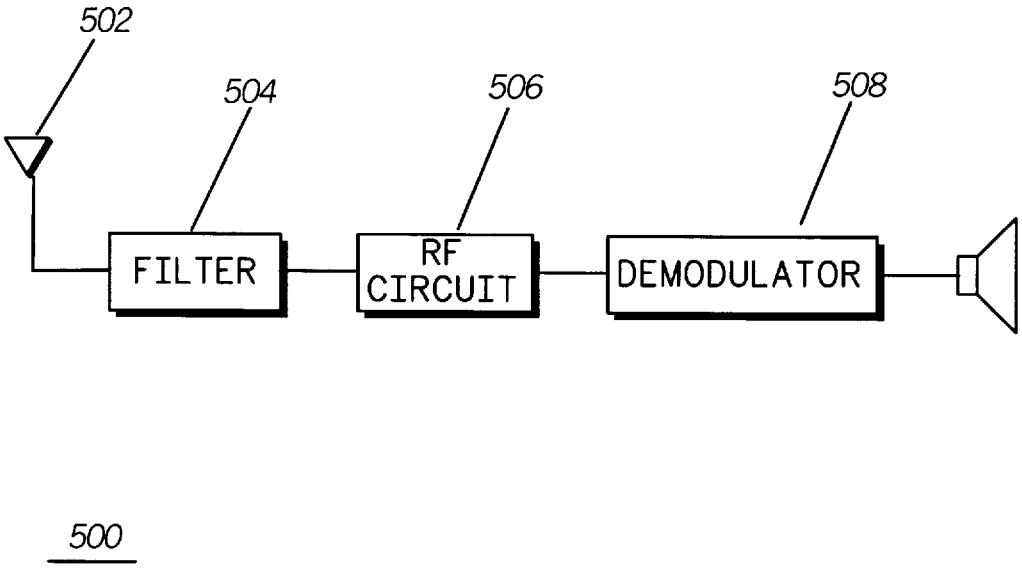
FIG. 7 shows a radio communication device in accordance with the present invention.

Referring to FIG. 7, a block diagram of a communication device 500 is shown. The device 500 includes an antenna 502 where radio frequency signals are received. The signals are coupled to a filter 504 followed by RF circuits 506. The RF circuits 506 comprises the remaining RF components of the device 500. The radio frequency signals received at the block 506 are coupled to the demodulator 508 which demodulates the carrier to produce the information signal. This information signal is coupled to a speaker 510. The RF circuit 506 includes, among other components, a resonator similar to 100 in accordance with the present invention.

In summary, a resonator is fabricated via either the multilayer ceramic or the multilayer PC board process and having a distributed capacitor along its length. The resonator is formed via a series of half loops, circular or rectangular, printed on a plurality of dielectric substrates. These half circles (loops) are interconnected on each subsequent layer to form a coil. The distributed capacitance is realized via metallized areas that overlap each of the half circles. Therefore, each complete circle includes two pieces of distributed capacitance. The amount of capacitance is determined by the thickness of the dielectric, the material of the dielectric, and the area of the metallized areas which form the plates. The distributed capacitance can be desirably made trimmable as often required in high-end frequency selection (filtering) applications. Significant benefits are realized by the principles of the present invention, which include considerable size reduction, and an improvement in the Q of the resonator.

The present invention provides for a resonator that accomplishes volumetric efficiency by incorporating a distributed capacitor along its length. This resonator may be incorporated in various electronic devices with maximum volumetric efficiency. A benefit of the present invention is that reduction in transmission line length is readily achieved with minimum effect on the mutual inductance of the basic helical coil structure. Replacing a portion of the transmission line by the distributed shunt capacitor has the benefit in the resulting resonator Q due to the fact that the capacitor Q is usually dominated by the dielectric Q, which is generally very high, while the transmission line Q is usually dominated by the Metal Q, which is generally poor.

It is understood that the resonator 100 shows the preferred embodiment of the present invention. Metallized areas having substantially square shapes are used only as a means to demonstrate the preferred embodiment and are not intended to limit the scope of the present invention. Modifications to the metallized areas may be made to achieve similar results without departing from the spirit of the invention. Indeed, metallized areas having arced section may be used to provide possible improvements in the Q of the resonator by alleviate the effects of current bunching around a sharp corner.

What is claimed is:

1. An electrical circuit device, comprising:

a ground plane;

a transmission line having a length and formed via a plurality of substrates of electrically insulating material each having first selective metallized pattern thereon and each coupled to a subsequent layer via an interconnect in order to form a loop of metallized layers substantially creating a coil;

a distributed capacitor shunted to the ground plane and fabricated along the length of the transmission line via second selective metallized patterns on the plurality of substrates, the first selective metallized patterns form a first plate of the distributed capacitor and the second selective metallized patterns form the second plate of the distributed capacitor, the first and second plates are separated via the plurality of substrates;

an input port for coupling an input signal to the electrical circuit device; and an output port for coupling the electrical circuit device to an output device.

2. The electrical circuit device of claim 1, wherein the first selective metallized patterns include a half square loop.

3. The electrical circuit of claim 1, wherein the second selective metallized patterns include a square metallized area.

4. A resonator having a ground plane, comprising:

a helical coil transmission line having a length and comprising:

a plurality of dielectric layers each having a major surface with first and second selective metallized areas thereon;

first means for coupling the first selective metallized areas of each of the plurality of dielectric layers to form the transmission line; and second means for coupling the second selective metallized areas of each of the plurality of dielectric layers to form a distributed capacitor shunted to the ground plane along the length of the transmission line.

5. The resonator of claim 4, further comprising an input port coupled to the first selective metallized area in order to couple an input signal to the resonator.

6. The resonator of claim 4, further comprising an input port coupled to the second selective metallized area in order to couple an input signal to the resonator.

7. The resonator of claim 4, further comprising an output port coupled to the first selective metallized area in order to couple the resonator to an output device.

8. The resonator of claim 4, further comprising an output port coupled to the second selective metallized area in order to couple the resonator to an output device.

9. The resonator of claim 4, wherein the first means for coupling include metallized through holes.

10. The resonator of claim 4, wherein the second means for coupling include metallized through holes.

11. The resonator of claim 4, wherein the first means for coupling include metallized vias.

12. The resonator of claim 4, wherein the second means for coupling include metallized vias.

13. The resonator of claim 4, wherein the plurality of dielectric layers include ceramic layers.

14. A resonator, comprising:

a first substantially metallized layer of substrate to form a first ground plane;

a plurality of substrates vertically stacked and attached to the first ground plane;

each of the plurality of substrates includes first selectively metallized areas which form half loops having first and second terminals, the half loops on each subsequent substrates are connected to each other via alternate terminals to form a coil having a length; and each of the plurality of substrates further includes second selectively metallized areas constituting first plates of a distributed capacitor shunted to the first ground plane along the length of the coil using the half loops of adjacent substrates as second plates said distributed capacitor.

15. A radio communication device, comprising:

a receiver having a radio frequency circuit for receiving a radio frequency signal, the circuit including a resonator and the resonator comprising:

a helical coil transmission line having a length and further comprising:

a ground plane;

a plurality of dielectric layers each having a major surface with first and second selective metallized areas thereon;

means for coupling the first selective metallized areas of each of the plurality of dielectric layers to form the transmission line; and means for coupling the second selective metallized areas of each of the plurality of dielectric layers to form a distributed capacitor along the length of the helical core transmission line and said distributed capacitor shunted to the ground plane.

* * * * *